United States Patent [19]

Levkovitch

[11] 4,192,563

[45] Mar. 11, 1980

[54] DEVICE FOR DISPLAYING SAMPLES OF DRAPES, FABRICS OR OTHER TEXTILE PRODUCTS

[76] Inventor: Shimon N. Levkovitch, Hapalmach 32, Tel Aviv, Israel

[21] Appl. No.: 919,986

[22] Filed: Jun. 28, 1978

[30] Foreign Application Priority Data

Jun. 30, 1977 [IL] Israel ..... 52418

[51] Int. Cl.[2] ..... A47F 3/08

[52] U.S. Cl. ..... 312/134; 312/268; 211/1.5; 198/858

[58] Field of Search ..... 312/268, 134; 211/1.5; 198/858, 832, 747

[56] References Cited

U.S. PATENT DOCUMENTS

| | | | |
|---|---|---|---|
| 928,980 | 7/1909 | Kaufman et al. | 312/134 |
| 1,613,330 | 1/1927 | Prescott | 312/134 |
| 1,739,497 | 12/1929 | Beach | 198/858 |
| 1,998,109 | 4/1935 | Walter, Jr. | 211/1.5 |
| 2,880,878 | 4/1959 | Collette | 312/134 |
| 2,899,072 | 8/1959 | Weiss | 211/1.5 |
| 3,252,581 | 5/1966 | Jenkins et al. | 211/1.5 |
| 3,696,523 | 10/1972 | Beeley et al. | 211/1.5 |
| 4,018,328 | 4/1977 | Galarowic et al. | 198/858 |

*Primary Examiner*—Victor N. Sakran
*Attorney, Agent, or Firm*—Benjamin J. Barish

[57] ABSTRACT

A device is described for displaying drapes, fabrics, or other products comprising a horizontal closed-loop track for receiving the upper ends of the samples to be displayed, which samples are interconnected together at their upper ends to form a closed loop slidable around the track. The device further includes a drive motor and a pusher member driven by the motor along a circular path partly coextensive with a curved end section of the closed loop track. The pusher member is engagable with the upper end of the interconnected samples and pushes them around the closed loop track from the front section, wherein the interconnected samples are extended at the front section for viewing, whereas at the rear section they are compacted.

9 Claims, 2 Drawing Figures

DEVICE FOR DISPLAYING SAMPLES OF DRAPES, FABRICS OR OTHER TEXTILE PRODUCTS

BACKGROUND OF THE INVENTION

The present invenion relates to a device for displaying drapes, fabrics, or other products to prospective purchasers to enable them to make a selection from a large number of such products. The invention is particularly useful for displaying samples of drapes, and is therefore described below with respect to this application.

Today, different samples of drapes are displayed to prospective purchasers in a number of different ways. Probably the most common way is merely to remove individual samples of the cloth from which the drapes are to be made, and to hold them by hand, or to hang them on a hanger, for viewing by the prospective purchaser; such a technique, however, is not only time-consuming and burdensome particularly to the seller, who most remove and return each sample, but also does not display the drapes in their finished pleated form. A second technique commonly used is to hang a number of the drapes on a wall for viewing by the prospective purchaser; but this technique is very limited as to the number of drapes that can be displayed in a relatively small space. A third technique is to mount the individual samples on arms each having one end slidable along a track and the other end free; but this technique also requires considerable space, and moreover, the samples are displayed to the prospective purchaser from their ends rather than from their fronts.

An object of the present invention is to provide a device for displaying drapes, fabrics, or other products having advantages in the above respects.

SUMMARY OF THE INVENTION

According to the present invention, there is provided a device for displaying drapes, fabrics or other products comprising a rigid closed loop track supported in a horizontal plane, and a flexible closed loop slidably supported on the track for suspending therefrom a plurality of vertically-hanging drapes, fabrics or other products to be displayed. The closed loop track has a front section and a rear section joined together by curved end sections. A drive motor drives a pusher member along a curved path partly coextensive with one of the curved end sections of the closed loop track between the trailing end of the track front section and the leading end of the track rear section. The pusher member is located to push the flexible closed loop along the mentioned curved end section of the track to cause it to slide therealong towards the rear section of the track, to thereby compact the flexible closed loop, and the products suspended therefrom, at the rear section of the track for space-saving purposes, and to extend it, and the products suspended therefrom, at the front section of the track for viewing purposes.

In the preferred embodiment of the invention described below, the closed loop track has elongated front and rear sections joined by semi-circular end sections, the pusher member being driven along a circular path whose center is located at the center of the semi-circular end section joining the trailing end of the front track section with the leading end of the rear track section.

In this described embodiment, both the front and rear sections of the closed loop track are substantially straight.

According to another feature in the preferred embodiment of the invention described below, the flexible closed loop is formed with pleats, and the pusher member is located to bear against the upper ends thereof. In the described preferred embodiment, the displayed products are pleated drapes whose upper ends are interconnected to constitute the flexible closed loop slidable along the track.

According to a further feature in the described preferred embodiment, the device further includes a motor control system including selective control means for either operating the motor drive continuously, or for terminating its operation after the pusher member has been driven through a complete circular path.

A displaying device constructed in accordance with the foregoing features provides a number of important advantages. Thus, it enables the seller to display a large number of products, e.g., samples of drapes, quickly and effortlessly in a limited space. Also, it presents the front of the completed article for viewing by the purchaser so that the purchaser can more easily picture how the particular sample would appear in its intended surroundings. In addition, it permits the purchaser to control the device remotely from a desired viewing location, and to have the device display the different samples either in a continuous or in an intermittent manner. It even enables the operation of the device by the purchaser from a location outside of the store, for example after the normal store hours.

Many other features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
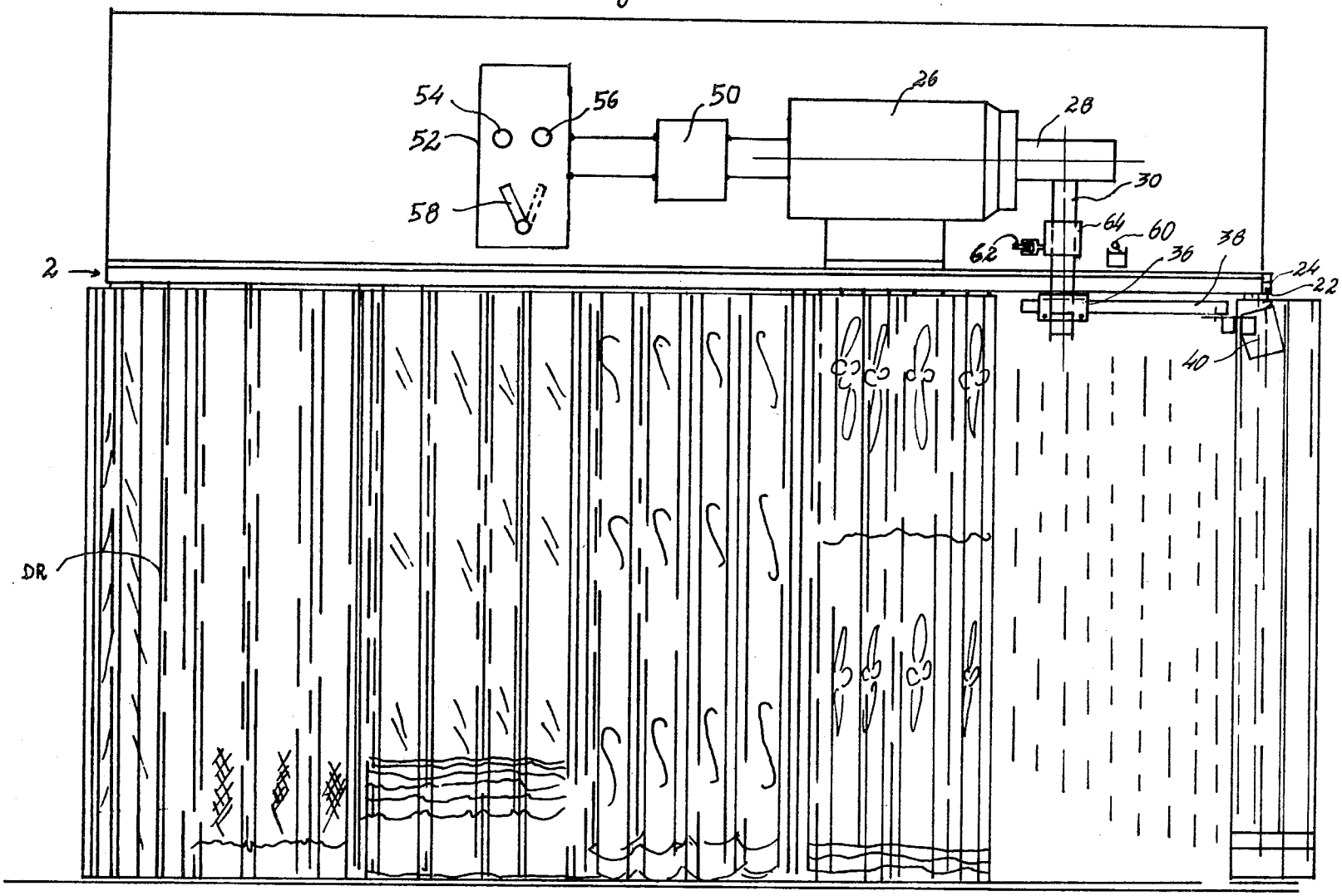
FIG. 1 is a front view of a drape-displaying device constructed in accordance with the invention.

The device illustrated in the drawings comprises a horizontal platform 2, of plywood or the like, supported by a pair of spaced vertical stands 4, 6 (FIG. 2) each having a plurality of feet 8, 10 for stably supporting the platform on a horizontal surface. Platform 2 is of oblong shape including opposed straight sides and semi-circular ends. Secured along the outer periphery of the platform is a closed loop track 12 of the type commonly used for slidably supporting the upper ends of drapes. The horizontal platform 2 and its closed loop track 12 are oriented such that section 14 (FIG. 2) of the track faces the front for viewing by the prospective purchaser, and section 16 faces the rear and is not normally viewable by the purchaser. The two curved end sections 18 and 20 joining the front section 14 and the rear section 16 are of semicircular shape having their centers of curvature at 18c and 20c, respectively.

The closed loop track 12 receives the upper ends of a plurality of vertically hanging pleated drapes DR which are slidably suspended from the track 12 in any suitable manner, such as by the use of the conventional hooks 22 (FIG. 1) received in elements 24 slidable along the track. The upper ends of the pleated drapes are interconnected together, for example by pins or stitching, to form a closed loop of drapes continuously encircling track 12 and slidable therealong.

Mounted on top of platform 2 is an electric motor 26 having a horizontal drive screw 28 which drives a vertical shaft 30. The latter shaft passes through an opening in the horizontal platform 2, and its opposite end is connected via a coupling 36, to a horizontal arm 38 carrying at its free end a pusher member 40. As shown particularly in FIG. 2, the axis of vertical shaft 30 is at the center of curvature 20c of the curved end section 20 of the track 12 joining the trailing end of the front track section 14 with the leading end of the rear track section 16. In addition arm 38, from the axis of vertical shaft 30 to pusher member 40, is of a length equal to the radius of the semi-circular end section 20 of the track.

Figure 2:
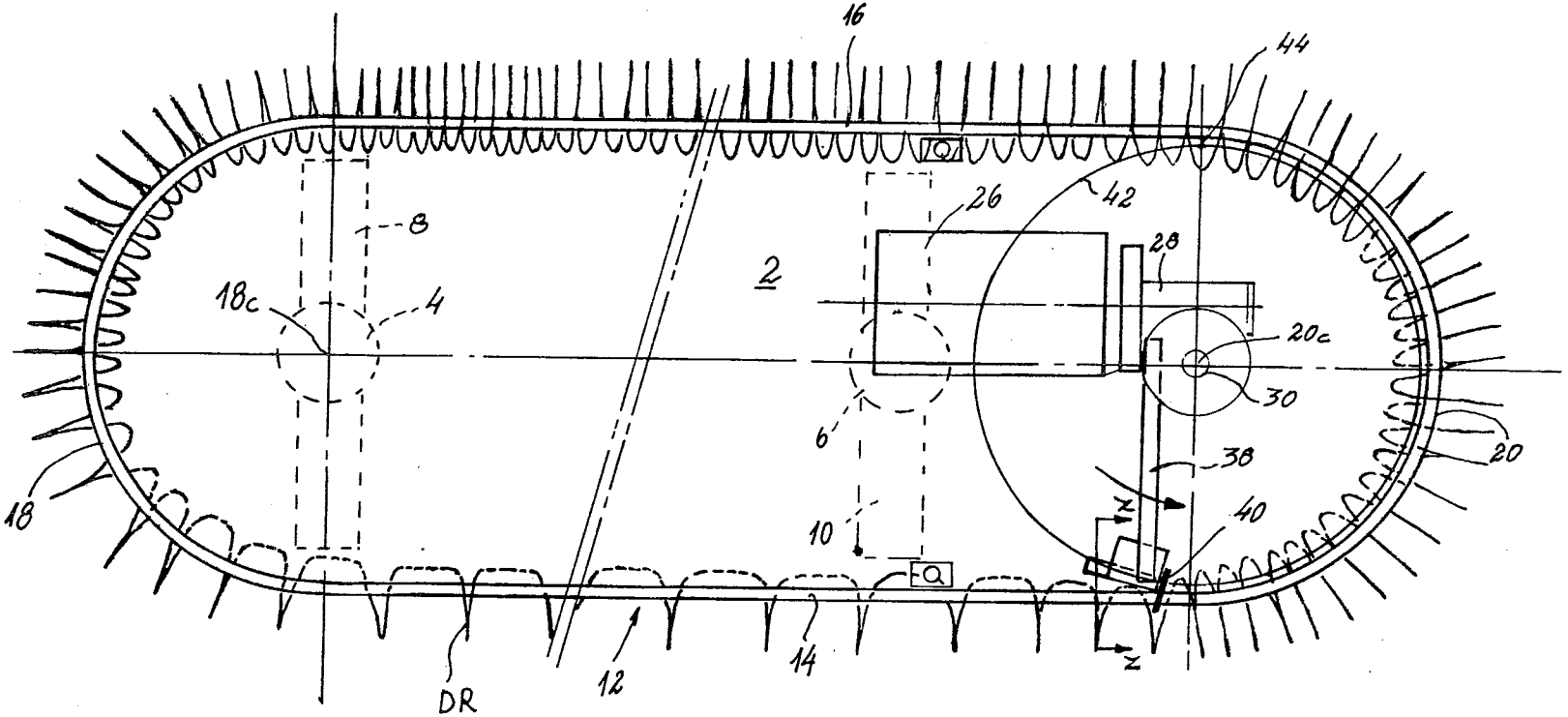
FIG. 2 is a top plan view of the device of FIG. 1.

It will thus be seen that when the electric motor 26 is energized to drive the pusher member 40, the latter will be driven along a circular path, shown by broken lines 42 in FIGS. 2, which for half its length is coextensive with the curved 20 of the track. Accordingly, when arm 38 is rotated by motor 26, pusher member 40 will follow the curved track section 20 for the first half cycle of rotation (i.e. 0°–180°), and will return to its starting point during the second half-cycle of rotation (180°–360°).

Pusher member 40 is located so as to engage the inner end of the pleats of the drapes, as shown particularly in FIG. 2. Thus, for the first 180° of movement of the pusher member, it pushes the engaged pleats of the drape along the semi-circular track section 20. This pushing of the engaged drape pleats causes all the drapes to move in the same direction along the track 12, whereupon the drapes in the rear track section 16 become compacted, as particularly shown in FIG. 2, whereas those in the front track section 14 become extended. At about the 180° point 44 of the circular path 42, the pusher member disengages from the pleated drapes and returns to the starting position illustrated in FIG. 2.

Thus, for each 360° cycle of rotation of the pusher member 40, a new sample of the drape is displayed in extended form in the front section 14 of the device, whereas the previous displayed sample is moved towards the rear section 16 wherein it is advanced in compacted form with the presentation of each new sample by a new cycle of operation of the electric motor 26 driving the pusher member 40.

The electric motor 26 driving the pusher member 40 is controlled by a control circuit, shown schematically in block form at 50 in FIG. 1, which in turn is controlled from a switchboard 52. The latter includes a START button 54, an OFF button 56, and a presettable lever 58 which is presettable in one position (full line position in FIG. 1) for operating the motor drive continuously, or in a second position (broken-line position in FIG. 1) for terminating the motor operation after the pusher member has been driven through a complete 360° cycle. The end of the 360° cycle is sensed by a limit switch 60 engageable by an eccentric 62 carried on a sleeve 64 fixed to the vertical shaft 30.

It will thus be seen that when lever arm 58 is preset to its full-line position, and the START button 56 is depressed, motor 26 will be continuously operated so as to continuously rotate pusher member 40 to automatically bring successive drape samples to the front track section 14 of the device where each sample may be individually viewed in extended form for the period of time the pusher arm 40 is driven through the second half of its 360° cycle; the OFF button 54 is depressed when the motor operation is to be terminated. On the other hand, when lever arm 58 is preset to the broken line position of FIG. 1, and the START button 56 is depressed, the motor 26 will be actuated to drive pusher member only through one 360° cycle until eccentric 62 engages limit switch 60, at which time the motor operation will be automatically terminated. This permits the displayed drape sample to be viewed as long as desired, and when a new drape sample is to be presented for viewing, the START button 56 is again depressed to initiate a new cycle of rotation of the pusher member 40.

The control system shown in block 50 for accomplishing the above control may be of known design.

It will be appreciated that many other variations, and modifications could be included, for example, an illuminating fixture could, and preferably would, be provided at the upper end of the front section of the device for illuminating the displayed drape samples. In addition, the vertical stands 4, 6 supporting the device could be provided externally of the closed loop track 12, rather than internally thereof. Further, the device could include two (or more) stores of suspended drapes, each having its own drive motor and control system. Finally, the device could be used for displaying samples of fabric or other products.

Many other variations, modifications and applications of the illustrated embodiment will be apparent.

What is claimed is:

1. A device for displaying drapes, fabrics or other products, comprising: a rigid closed loop track supported in a horizontal plane a flexible closed loop slidably supported on the track for suspending therefrom a plurality of vertically-hanging drapes, fabrics or other products to be displayed said closed loop track having a front section and a rear section joined together by curved end sections; a drive motor; and a pusher member driven by said drive motor along a curved path partly coextensive with one of the curved end sections of the closed loop track between the trailing end of the track front section and the leading end of the track rear section; said pusher member being located to push the flexible closed loop along said one curved end section of the closed loop track to cause it to slide therealong towards the rear section thereof to thereby compact the flexible closed loop track, and the products suspended therefrom, at said rear section of the track for space-saving purposes, and to extend the flexible closed loop, and the products suspended therefrom, at the front section of the track for viewing purposes.

2. A device according to claim 1, wherein said closed loop track has elongated front and rear sections joined by semi-circular end sections, said pusher member being driven along a circular path whose center is located at the center of the semi-circular end section joining the trailing end of the front track section with the leading end of the rear track section.

3. A device according to claim 2, when both said front and rear sections of the closed loop track are substantially straight.

4. A device according to claim 1, wherein said flexible closed loop is formed with pleats, and said pusher member is located to bear against the upper ends thereof.

5. A device according to claim 1, wherein said closed loop track is supported by a horizontal platform and extends along its outer periphery.

6. A device according to claim 5, wherein said drive motor is an electric motor and is supported on said horizontal platform.

7. A device according to claim 6, wherein said electric drive motor includes a horizontal drive screw driving a vertical shaft passing through an opening in said horizontal platform, the lower end of said shaft carrying a horizontal arm to which the pusher member is secured.

8. A device according to claim 1, further including a motor control system including selective control means for either operating the drive motor continuously, or for terminting its operation after the pusher member has been driven through a complete circular path.

9. A device according to claim 8, wherein said selective control means comprises a member presettable in one position for operating the drive motor continuously, or in a second position for terminating its operation after the pusher member has been driven through a complete circular path.

* * * * *